US007290413B2

(12) United States Patent
No et al.

(10) Patent No.: US 7,290,413 B2
(45) Date of Patent: Nov. 6, 2007

(54) WASHING MACHINE HAVING TRANSIENT VIBRATION SENSOR ASSEMBLY

(75) Inventors: Yang Hwan No, Changwon-si (KR); Jong Seok Kim, Changwon-si (KR); Han Ki Cho, Changwon-si (KR); Yeon Su Jung, Changwon-si (KR); Jung Hoon Kang, Changwon-si (KR); Young Hoon Ha, Masan-si (KR); Myung Sik Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 615 days.

(21) Appl. No.: 10/717,965

(22) Filed: Nov. 21, 2003

(65) Prior Publication Data

US 2004/0148973 A1 Aug. 5, 2004

(30) Foreign Application Priority Data

Nov. 28, 2002 (KR) ..... 10-2002-0075022

(51) Int. Cl.
*D06F 37/22* (2006.01)

(52) U.S. Cl. ..... 68/12.06; 68/23.1

(58) Field of Classification Search ..... 68/12.06, 68/12.16, 23.1

See application file for complete search history.

(56) References Cited

U.S. PATENT DOCUMENTS

| | | | | | |
|---|---|---|---|---|---|
| 3,227,835 | A * | 1/1966 | Conrath | 200/61.45 R |
| 3,504,777 | A * | 4/1970 | Waugh | 192/136 |
| 3,803,881 | A * | 4/1974 | Getz et al. | 68/12.06 |
| 4,098,098 | A * | 7/1978 | Altnau | 68/23 R |
| 4,884,845 | A * | 12/1989 | Schmale et al. | 297/367 |
| 5,685,038 | A * | 11/1997 | Smith et al. | 68/12.06 |
| 5,850,746 | A * | 12/1998 | Lee | 68/12.06 |
| 6,292,966 | B1 * | 9/2001 | Lim et al. | 68/12.06 |
| 6,422,047 | B1 * | 7/2002 | Magilton | 68/12.06 |
| 2003/0160141 | A1 * | 8/2003 | Yamanashi | 248/300 |
| 2004/0025545 | A1 * | 2/2004 | Chang | 68/23.1 |
| 2004/0154351 | A1 * | 8/2004 | Kim et al. | 68/12.06 |

* cited by examiner

*Primary Examiner*—Joseph L. Perrin
(74) *Attorney, Agent, or Firm*—Ked & Associates, LLP

(57) ABSTRACT

A washing machine having a transient vibration sensor assembly is provided. The transient vibration sensor assembly senses transient vibration of a tub to prevent the washing machine from severe shaking and subsequent breakdown. The washing machine includes a cabinet, a tub suspended in the cabinet, a drum rotatably provided in the tub, a motor provided in the cabinet to rotate the drum, a sensor assembly in the cabinet to sense a transient vibration of the tub, and a controller to control the motor, and to stop the motor if the sensor assembly senses that the tub is in a transient vibration state.

21 Claims, 6 Drawing Sheets

WASHING MACHINE HAVING TRANSIENT VIBRATION SENSOR ASSEMBLY

This application claims the benefit of Korean Application(s) No. 10-2002-0075022 filed on Nov. 28, 2002, which is/are hereby incorporated by reference.

BACKGROUND OF THE INVENTION

1. Field of the Invention

The present invention relates to a washing machine, and more particularly, to a washing machine having a transient vibration sensor assembly, which senses transient vibration of a tub to prevent the washing machine from heavy shaking or breakdown.

2. Discussion of the Related Art

Generally, a washing machine is an apparatus for eliminating dirt or filth attached to a laundry using reaction between water and detergent.

Such a washing machine is classified into a pulsator type, an agitator type, and a drum type. The agitator type washing machine rotates an agitator protruding from a bottom center of a tub in forward and reverse directions to perform washing. The pulsator type washing machine rotates a disc-type pulsator on a bottom of a tub in forward and reverse directions to perform washing using a frictional force between a generated current and a laundry. And, the drum type washing machine rotates a drum holding water, detergent, and laundry to perform washing. In this case, a plurality of tumbling ribs protrude from an inside of the tub.

Meanwhile, when the washing machine performs washing, rinsing, or dewatering, i.e., when the agitator, pulsator, or drum rotates, the laundry may gather to be entangled. In such a case, a tub of a washing machine heavily shakes to hit an inside of a cabinet.

Thus, if the tub shakes excessively, the washing machine makes a serious noise and the cabinet or tub may be broken. Moreover, if the tub shakes excessively, the washing machine rocks from side to side to move.

SUMMARY OF THE INVENTION

Accordingly, the present invention is directed to a washing machine having a transient vibration sensor assembly that substantially obviates one or more of the problems due to limitations and disadvantages of the related art.

An object of the present invention, which has been devised to solve the foregoing problem, lies in providing a washing machine having a transient vibration sensor assembly, which prevents the washing machine from being broken down or from shaking heavily to move on transient vibration of a tub.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine including a cabinet, a tub suspended in the cabinet, a drum rotatably provided in the tub, a motor in the cabinet to rotate the drum, a sensor assembly in the cabinet to sense a transient vibration of the tub, and a control unit controlling the motor, the control unit stopping the motor if the tub is in the transient vibration.

The sensor assembly may include a bracket attached to an inside of the cabinet, an arm hinge-coupled with the bracket wherein one end of the arm is disposed to leave a predetermined distance from the tub so that the arm is contacted with the tub to rotate when the tub is in the transient vibration, and a sensor mounted on the arm, the sensor senses the transient vibration of the tub to output a sense signal to the control unit when the arm rotates.

The bracket may include a first hole provided at a lateral side wherein a coupling member penetrating into the cabinet is inserted in the first hole and a second hole provided at one end to have the arm hinge-coupled thereto. The bracket may further include a first hook protruding from the lateral side to be inserted in a second aperture of the cabinet so that the bracket is temporarily fixed to the cabinet.

The arm may include a hinge shaft protruding to be fitted to the bracket and a wall body on an upper surface to have the sensor fitted thereto. In this case, the arm may further include a second hook protruding from the wall body to be caught on a top end of the sensor fitted to the wall body. Moreover, the arm may further include a protrusion protruding from an upper surface to catch a bottom end of the sensor fitted to the wall body thereon to prevent the sensor from being separated.

And, the sensor may include a housing having a cavity inside to be mounted on the arm, a transmitting unit installed at one side of the housing, a ball provided in the cavity to move when the arm rotate, and a receiving unit installed at the other end of the housing to confront the transmitting unit and to receive a signal of the transmitting unit to output to the control unit.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
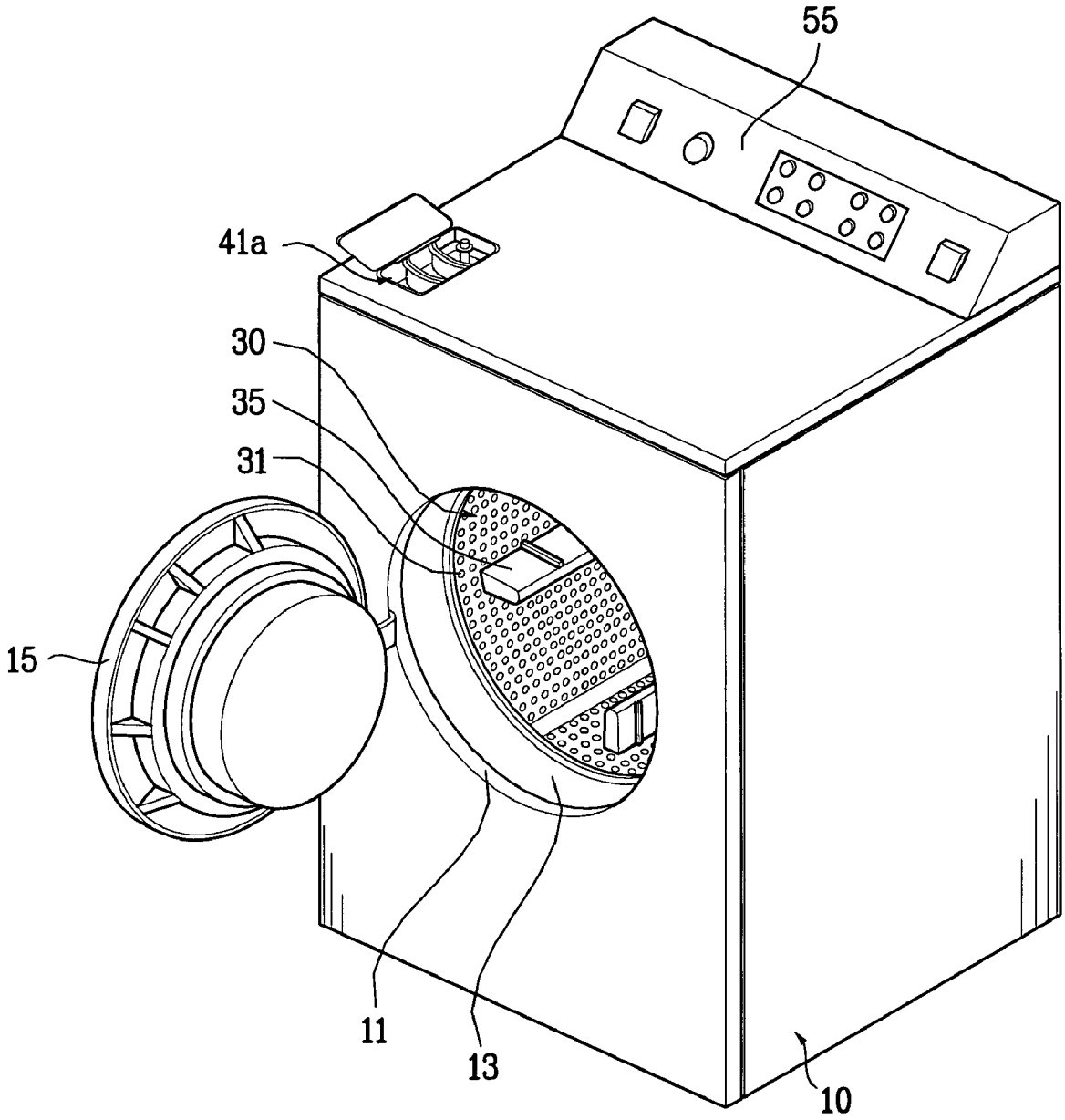
FIG. 1 is a perspective view of a washing machine according to one embodiment of the present invention.
Figure 2:
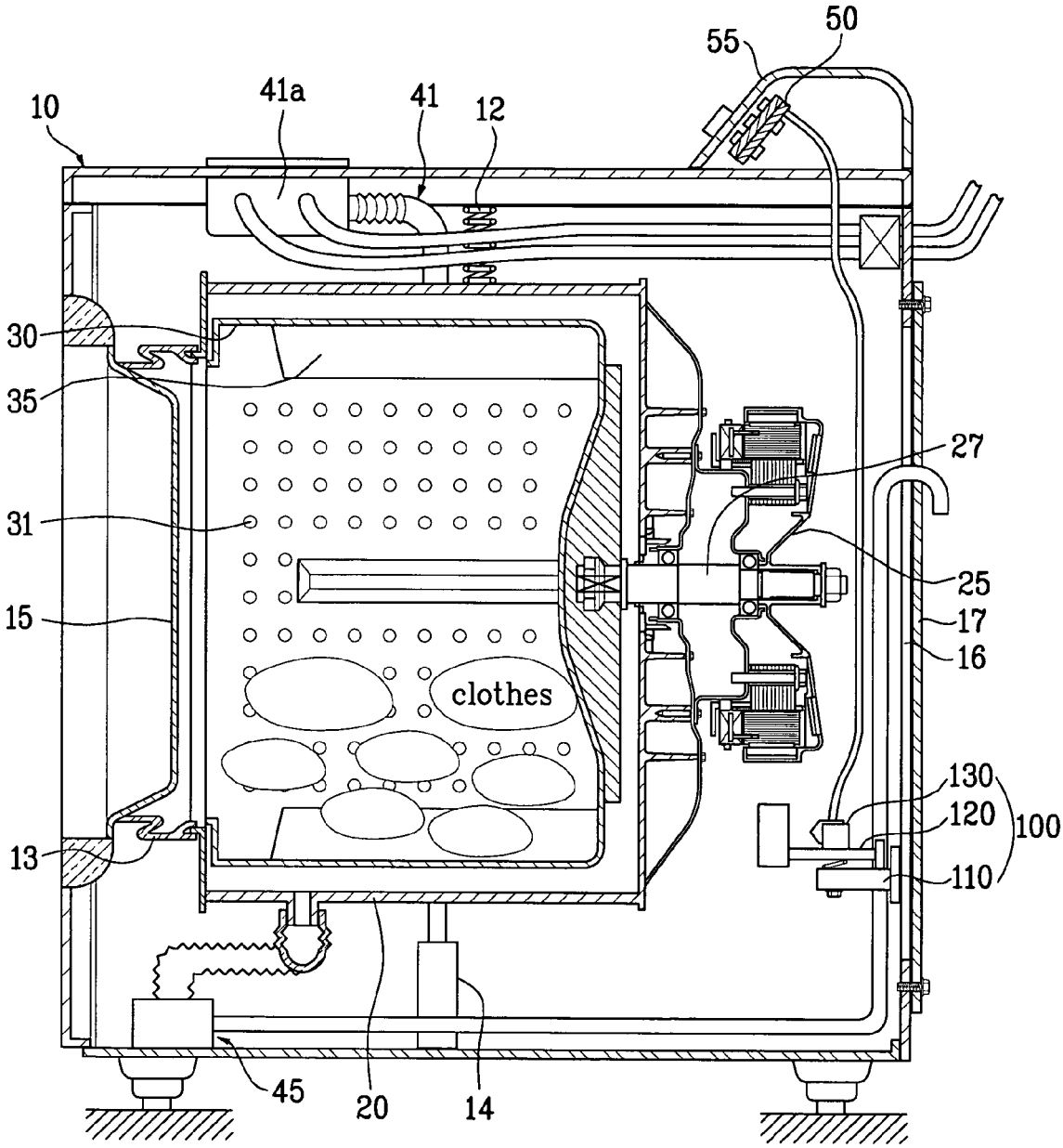
FIG. 2 is a cross-sectional view of a washing machine in FIG. 1.

FIG. 1 is a perspective view of a washing machine according to one embodiment of the present invention and FIG. 2 is a cross-sectional view of a washing machine in FIG. 1.

Referring to FIG. 1 and FIG. 2, a tub is suspended in a cabinet 10. For this, a top of the tub 20 is connected to a spring 12 fixed to the cabinet 10 and a bottom of the tub 20 us connected to a damper 14 hinge-coupled with a bottom of the cabinet 10. The provided spring and damper 12 and 14 plays a role in suspending the tub in the cabinet 10 elastically as well as attenuating vibration applied to the tub 20 while a washing machine operates.

A drum 30 is rotatably provided in the tub 20. For this, a motor 25 is provided in the cabinet, and more specifically, in rear of the tub 20 and the drum 30 is connected to the motor 25 through a shaft 27.

A multitude of perforated holes 31 perforate into a circumference of the drum 30 and a plurality of tumbling ribs 35 are provided on an inner circumference of the drum 30. Hence, water supplied to the tub 20 enables to communicate between the drum 30 and the tub 20 via the perforated holes 31. A laundry having put in the drum 30 is lifted up by the tumbling ribs 35 and then falls down while the drum 30 rotates. Hence, a sufficient frictional and shock energy can be sufficiently provided for washing when the laundry falls down.

An entrance 11 is provided at a front side of the cabinet 10 so that the laundry is put in or out of the drum 30 and a door 15 is provided to open/close the entrance 11. A gasket 13, as shown in FIG. 2, is provided between the entrance 11 and an opening of the tub 20 to prevent the water held in the drum and tub 30 and 20 from leaking.

A large opening 16 is provided at a rear side of the cabinet 10 and a panel 17 is provided on the rear side of the cabinet 10 to open/close the opening 16. In case that the washing machine is out of order, the panel 17 is separated from the cabinet 10 and parts in the cabinet 10 can be repaired or replaced through the opening 16.

A water supply equipment 41 and a drain equipment 45 are provided in the cabinet 10. The water supply equipment 41 supplies water and detergent to the tub 20 and the drain equipment 45 discharges the water in the tub 20 outside. Meanwhile, a non-described number '41*a*' is a detergent box filled with the detergent.

A control panel 55 is provided on a top of the cabinet 10 and a control unit 50 is provided in the control panel 55. The control unit 50 controls the water supply and drain equipments 41 and 45 as well as other parts. Hence, a user operates the washing machine by manipulating the control panel 55.

Referring to FIG. 2, a sensor assembly 100 sensing transient vibration of the tub 20 to output a signal to the control unit 50 is provided in the cabinet 10. The sensor assembly 100 includes a bracket 110 attached to the cabinet 10, an arm 120 hinge-coupled with the bracket 110, and a sensor 130 mounted on the arm 120.

Figure 3:
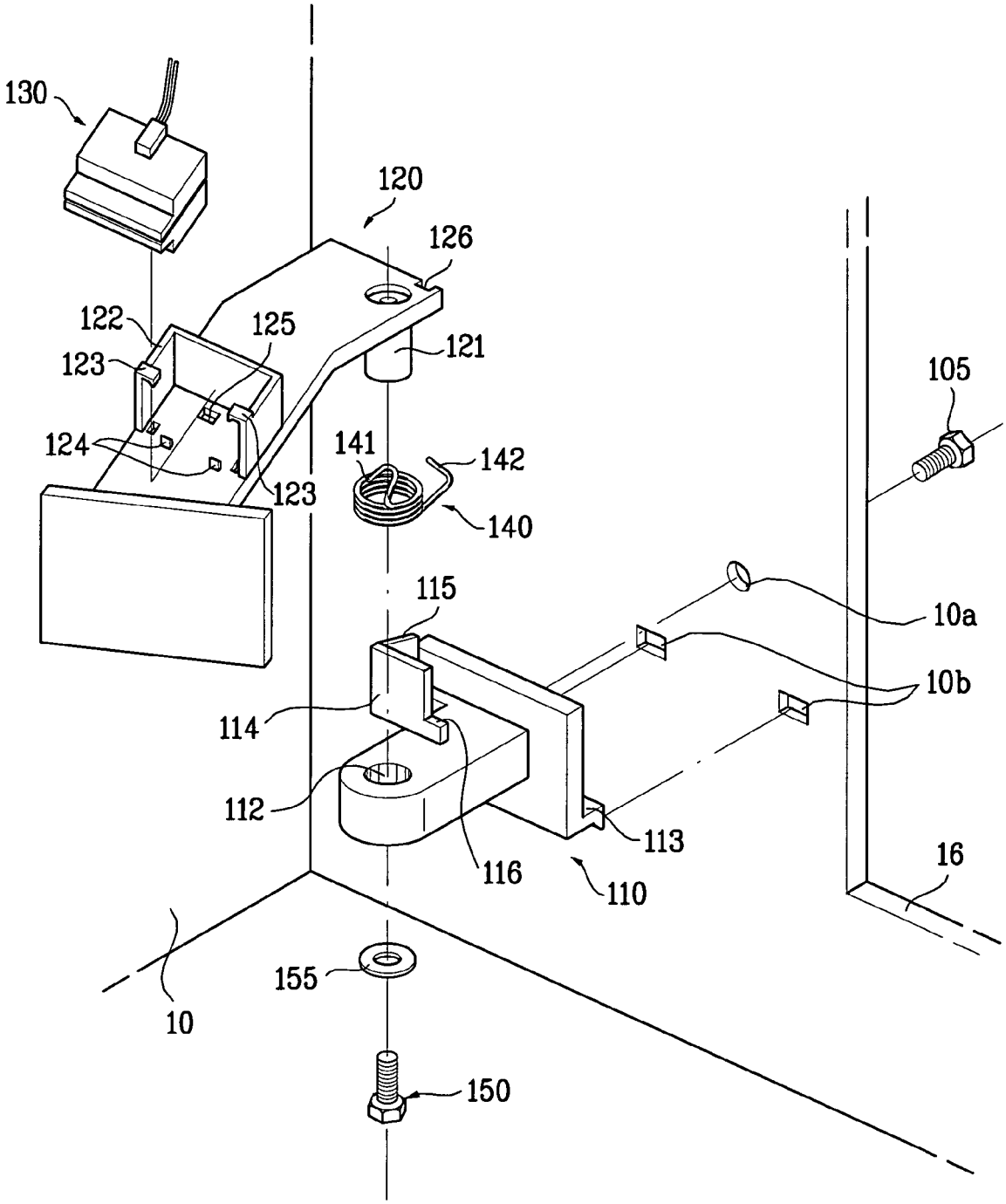
FIG. 3 is a perspective view of a disassembled sensor assembly of a washing machine in FIG. 1.

A structure of the sensor assembly 100 is explained by referring to FIGS. 3 to 6 as follows. FIG. 3 is a perspective view of a disassembled sensor assembly of a washing machine in FIG. 1, FIG. 4 is a rear view of a bracket of a sensor assembly in FIG. 3, FIG. 5 is a cross-sectional view of an sensor assembly in FIG. 4, and FIG. 6 is a cross-sectional view of a sensor of a sensor assembly in FIG. 3.

Figure 4:
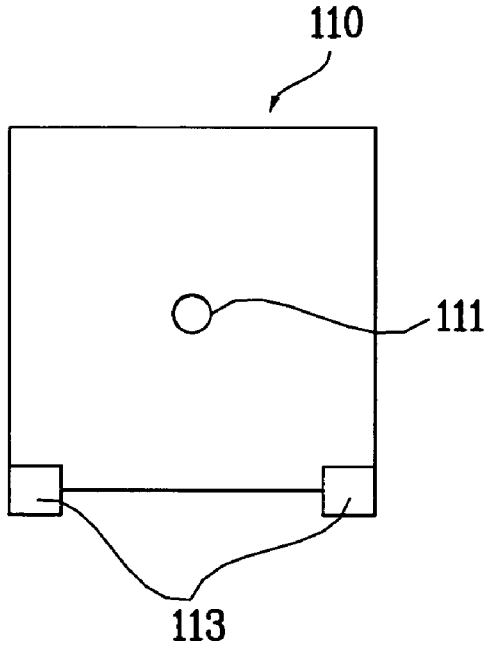
FIG. 4 is a rear view of a bracket of a sensor assembly in FIG. 3.
Figure 5:
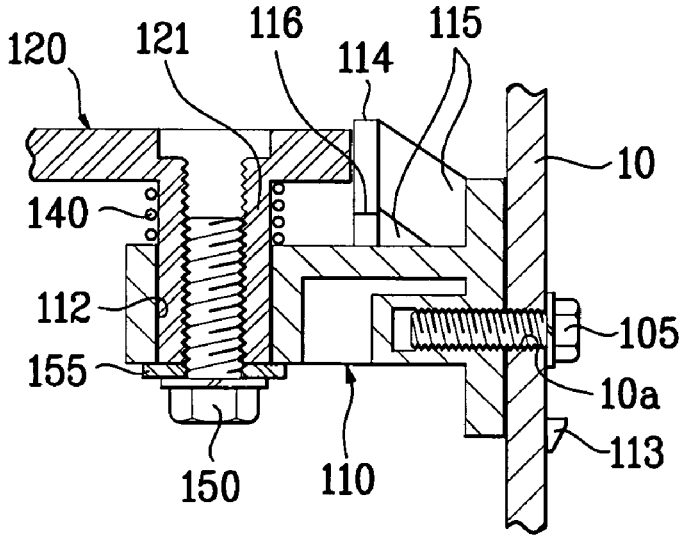
FIG. 5 is a cross-sectional view of an sensor assembly in FIG. 4.
Figure 6:
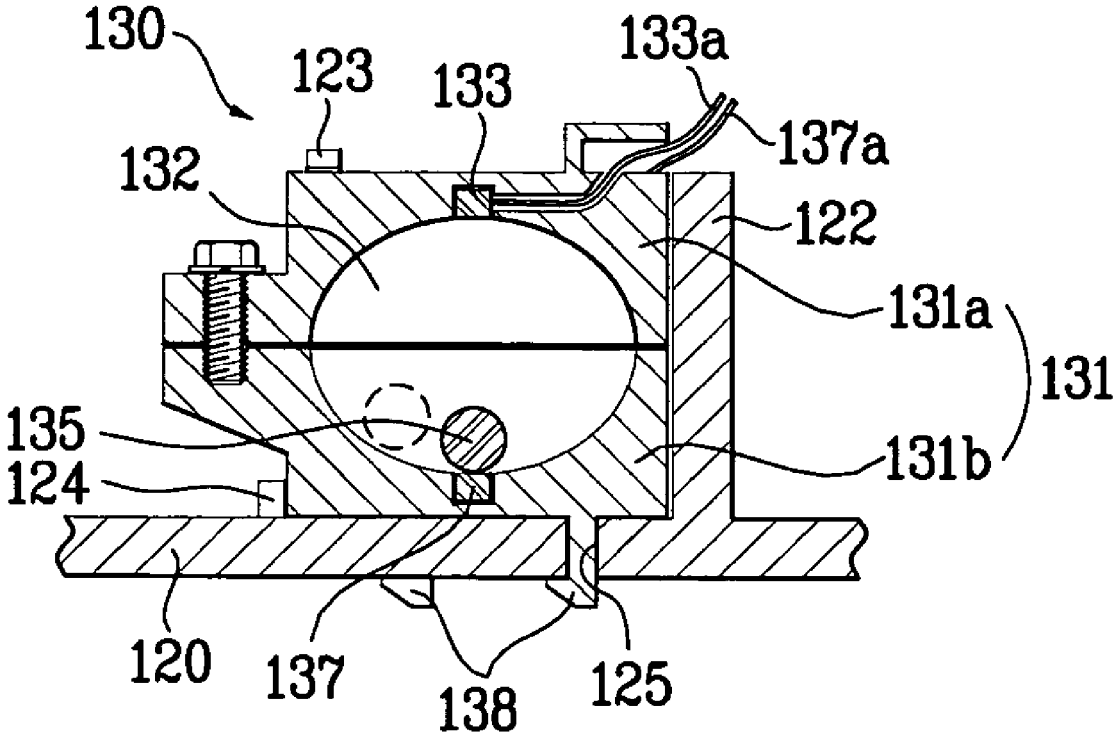
FIG. 6 is a cross-sectional view of a sensor of a sensor assembly in FIG. 3.

Referring to FIGS. 3 to 5, the bracket 110 is attached to an inside of the cabinet 10, for example, to an inside of the rear side of the cabinet 10. For this, a first hole 111 and a first aperture 10*a* is provided at a lateral side of the bracket 110 and the rear side of the cabinet 10, respectively. For coupling, a coupling member 105, e.g., screw or bolt, penetrates into the first aperture 10*a* to be inserted in the first hole 111.

A second hole 112 penetrates into an end of the bracket 110 so that the arm 120 is hinge-coupled thereto. The second hole 112 is provided along a vertical direction to the end of the bracket 110 for example.

Meanwhile, a first hook 113 may further be provided at the bracket 110. The first hook 113 protrudes from a lateral side of the bracket 110, and is the fitted to a second aperture 10*b* provided at the cabinet 10 to be coupled thereto. If the first hook 113 is further provided, the bracket 110 is temporarily fixed to an accurate position using the first hook 113. The bracket 110 is then strongly fixed using the coupling member 105. Hence, the corresponding assembly job is facilitated to improve productivity.

Referring to FIGS. 3 to 5, the arm 120 includes a hinge shaft 121 coupled with the bracket 110 and a wall body 122 built up on an upper surface of the arm 120.

The hinge shaft 121 protrudes from the arm 120 downward, and is fitted to the second hole 112 to be coupled thereto. Hence, the arm 120 is installed to rotate centering on the hinge shaft 121.

And, the wall body 122 is built up straight on the upper surface of the arm 120 so that the sensor 130 is fitted thereto to be mounted thereon. The wall body 122, as shown in is FIG. 3, has a shape enclosing a predetermined space to have the sensor 130 mounted thereon stably. Moreover, the wall body 122 has one open side, e.g., 'U' type open side, so that the sensor 130 is easily inserted in the predetermined space.

The end, as shown in FIG. 2, of the arm 120 hinge-coupled with the bracket 110 is arranged to leave a predetermined distance from the tub 20. Hence, if the tub 20 excessively vibrates to touch the end of the arm 120, the arm 120 rotates centering on the hinge shaft 121.

Meanwhile, a bolt 150 and a washer 155, as shown in FIG. 3 and FIG. 5, are further provided to the sensor assembly 100 so that the arm 120 is more stably coupled with the bracket 110.

The bolt 150 is coupled with an end of the hinge shaft 121 fitted to the second hole 112 of the bracket 110 from a bottom side of the bracket 110. And, the washer 155 is provided between a head of the bolt 150 and the end of the hinge shaft 121. In this case, an inside diameter of the washer 155 is greater than a diameter of the second hole 112 but is smaller than a diameter of the head of the bolt 150. Once the bolt and washer 150 and 155 are provided, it is able to prevent the hinge shaft 121 from being separated from he second hole 112 by an external force.

An elastic member 140 is further provided to the sensor assembly 100 to absorb shock transferred to the arm 120 on transient vibration of the tub 20 and to return the arm 20 having rotated by the tub 20 to its original position.

A spring, as shown in FIG. 5, may be used as the elastic member 140. The spring includes one end 141 engaged with the arm 120, the other end 142 engaged with and the bracket 110, and a coil type middle portion. Meanwhile, a recess 126 is provided at the arm 120 to have one end 141 of the elastic member 140 caught thereon. And, a cut-away portion 116 is provided at the bracket 110, and more specifically, at a stopper 114 (described later) to have the other end 142 of the elastic member 140 caught thereon.

The coil type middle portion of the elastic member 140 is preferably installed to enclose an outer circumference of the hinge shaft 121. This is for effectively preventing the elastic member 140 from being separated outside by a shock.

Once the above-constructed elastic member 140 is provided, the arm 120 having been rotated by the tub 20 enables to return to its original position by an elastic force of the elastic member 140. Yet, if the arm 120 is rotated excessively when returning to its original position by the elastic force, the tub 20 in transient vibration will have difficulty in touching the end of the arm 120. Hence, a means for preventing the returning arm 120 from over-rotating in a reverse direction is needed.

For this, the stopper 114 can be further provided to the bracket 110. The stopper 114, as shown in FIG. 3 and FIG. 5, extends upward from an upper surface of the bracket 110 to prevent a reverse rotation of the arm 120, which is explained in detail as follows.

First of all, the stopper 114 supports one side of both ends of the arm 120 in the vicinity of the hinge shaft 121. In this case, the elastic member 140 exerts a force to push the arm 120 toward the stopper 114 so that the arm 120 maintains to be contacted with the stopper 114. Hence, the arm 120 always enables to maintain a fixed position when the tub 20 is not in transient vibration. The arm 120, which is returning to its original position after having been rotated by the transient vibration of the tub 20, maintains an initial position after the rotation until being contacted with the stopper 114.

Thus, since the stopper 114 prevents the reverse rotation of the arm 120, the arm 120 enables to maintain a position enabling to be contacted with the tub 20 in the transient vibration.

Meanwhile, the stopper 114 receives the elastic force of the elastic member 140 when brought tight contact with the arm 120. And a great shock is applied to the stopper 114 when the rotated arm 120 returns. Hence, a means for preventing the stopper 114 from being pushed by the arm 120 is needed.

For this, a reinforcement rib 115 arranged in rear of the stopper 114 to support is further provided to the bracket 110. The reinforcement rib 115 extends from the upper surface of the bracket 110 to be arranged to greatly support the stopper 114. For instance, the reinforcement rib 115 is arranged vertical to the stopper 114. Besides, the stopper 114 and reinforcement rib 115 are preferably built in one body of the bracket 110.

Meanwhile, the sensor 130, as shown in FIG. 2 and FIG. 3, is mounted on the arm 120, and senses the transient vibration of the tub 20, when the arm 12 rotates due to the transient vibration of the tub 20, to output a signal to the control unit 50.

The sensor 130 is fitted to the wall body 122 of the arm 120 to be fixed thereto. Yet, the arm 120 comes into moving such as rotation centering on the hinge shaft 121 by the tub 20 in the transient vibration. Moreover, the cabinet 10 and the sensor assembly 100 fixed to the cabinet 10 come into vibration as well when the tub 20 is in the transient vibration. Hence, a means for preventing the sensor 130, which is inserted in the wall body 122 of the arm 120, from being separated from the space provided by the wall body 122 is needed, which is explained as follows.

Referring to FIG. 3, a pair of second hooks 123 and a pair of protrusions 124 may be further provided to the arm 120 to prevent the sensor 130, which is inserted in the wall body 122 of the arm 120, from being separated from the wall body 122. Barbs of the second hooks 123 protrude from the wall body 122 to catch a top end of the sensor 130 fitted to the wall body 122 thereon. And, the protrusions 124 protrude from the upper surface of the arm 120 to catch a bottom end of the sensor 130 fitted to the wall body 122 thereon. With such a structure, the second hooks 123 and the protrusions 124 are caught on the top and bottom ends of the sensor 130, respectively, whereby the sensor 130 is prevented from being separated from the wall body 122.

Referring to FIG. 3 and FIG. 6, a third hook 138 and a third aperture 125 may be further provided to the sensor assembly 100 to prevent the sensor 130 fitted to the wall body 122 from being separated through an open side of the wall body 122. The third hook 138, as shown in FIG. 6, protrudes from a bottom of the sensor 130 downward and the third aperture 125 is provided at the upper surface of the arm 120 to have the third hook 138 fitted thereto. With such a structure, the sensor 130 is not separated from the wall body 122 even if severe vibration or shock is applied to the sensor assembly 100.

The sensor 130, as shown in FIG. 6, having stably mounted on the arm 120 includes a housing 131, transmitting and receiving units 133 and 137 provided in the housing 131, and a ball 135 provided in a cavity 132 of the housing 131.

The housing 131 is fitted to the wall body 122 of the arm 120 and has the cavity 132 provided inside. The housing 131 includes a pair of pieces 131*a* and 131*b* detachable to each other. Namely, the housing includes a top housing 131*a* and a bottom housing 131*b*. A bottom of the top housing 131*a* and a top of the bottom housing 131*b* are formed concave. Hence, when the top and bottom housings 131*a* and 131*b* are assembled to each to each other, the cavity 132, as shown in FIG. 6, is formed in the housing 131.

The transmitting unit 133 is loaded on one side of the housing 131 and the receiving unit 137 is loaded on the other side of the housing 131 to confront the transmitting unit 133, whereby a signal outputted from the transmitting unit 133 is received by the receiving unit 137. In this case, the transmitting unit 133 and the receiving unit 137 are arranged to be contacted with the cavity 132. Preferably, one of the transmitting unit 133 and the receiving unit 137 is installed at an upper side and the other is installed at a lower side. The transmitting unit and receiving units 133 and 137 are electrically connected to the control unit 50 via cables 133*a* and 133*b*, respectively.

The ball 135 is provided inside the cavity 132 so as to lie between the transmitting unit and receiving units 133 and 137 while the arm 120 fails to rotate. The ball 135 is preferably provided to maintain an initial position when the arm 120 fails to rotate or to leave the initial position only when the arm 120 rotates. For this, a bottom inside of the housing 131 is formed concave. With such a structure, compared to a flat bottom inside of the housing 131, the concave bottom inside of the ball 135 enables to maintain its original position more accurately.

If the sensor 130 is constructed with the above-described structure, the receiving unit 137 is unable to receive the signal outputted from the transmitting unit 133 due to the ball 135 when the arm 120 fails to rotate 120 since the tub 20 is not in the transient vibration. On the other hand, if the arm 120 rotates due to the transient vibration of the tub 20, the ball 135 moves so that the receiving unit 137 receives the signal of the transmitting unit 133 to transfer to the control unit 50.

An operation of the above-constructed washing machine according to the present invention is explained as follows.

First of all, a laundry is put in the drum 30, the door 15 is closed, and the control panel 55 is manipulated. The water supply equipment 41 then supplies the water and detergent to the drum 30 appropriately. When the drum 30 rotates, the laundry is lifted up by the tumbling ribs 35 and then falls down for washing.

After completion of washing, the drain equipment 45 discharges the used water in the drum and tub 30 and 20. After completion of draining, the water supply equipment 41 supplies the drum 30 with water. The drum 30 then rotates to rinse the laundry. After completion of first rinsing, the drain equipment 45 discharges the water used for the first rinsing. Such a rinsing step is repeated at least one time.

After completion of overall rinsing, the drum 30 rotates at high speed. Water contents involved in the laundry are separated from the laundry by a centrifugal force. After completion of dewatering, a user supplies hot air to the drum 30 to completely dry the laundry. Finally, the user attains the fully washed and dried laundry.

Meanwhile, during the washing, rinsing, and dewatering, massive vibrations are applied to the tub 20. The vibrations applied to the tub 20 are attenuated by the spring 12 and damper 14. Yet, if the tub 20 excessively vibrates, the spring and damper 12 and 14 are unable to attenuate the vibration of the tub 20 so that the tub 20 shakes severely.

Figure 7A:
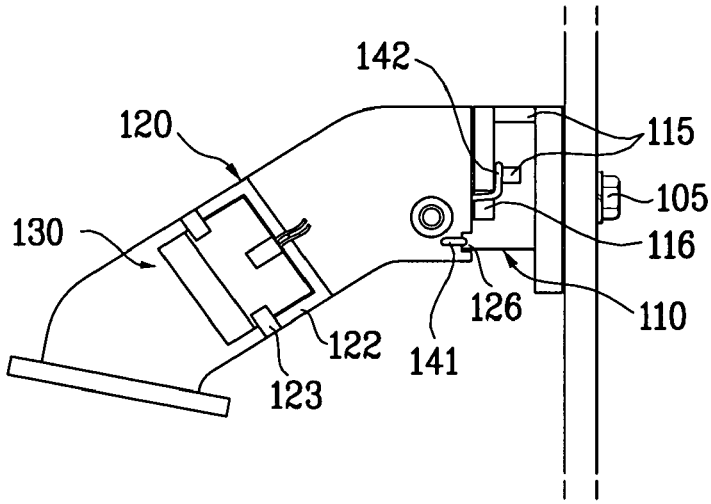
FIG. 7A is a plane view of a sensor assembly in FIG. 3 when a tub is not in transient vibration.
Figure 7B:
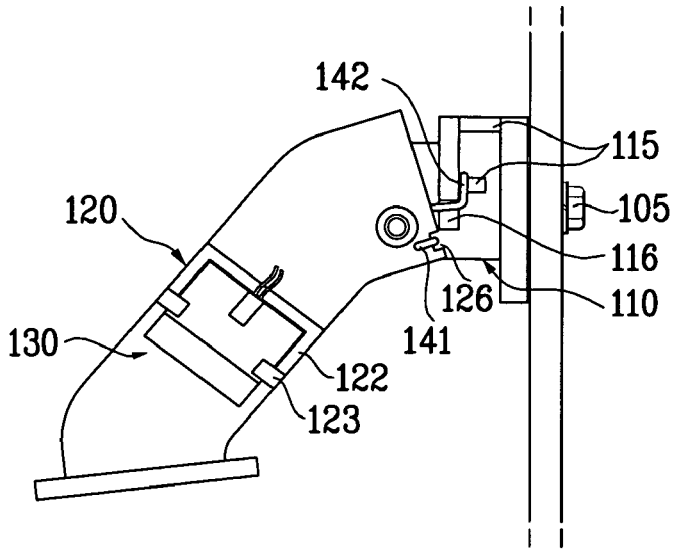
FIG. 7B is a plane view of a sensor assembly in FIG. 3 when a tub is in transient vibration.

In this case, the sensor assembly 100 senses the transient vibration of the tub 20 to output the corresponding signal to the control unit 50. The control unit 50 then stops the motor 25 to prevent the tub and cabinet 20 and 10 from being broken. Such a procedure is explained in detail by referring to FIG. 6, FIG. 7A, and FIG. 7B as follows. FIG. 7A is a plane view of a sensor assembly in FIG. 3 when a tub is not in transient vibration and FIG. 7B is a plane view of a sensor assembly in FIG. 3 when a tub is in transient vibration.

When the tub 20 is not in the transient vibration, the arm 120, as shown FIG. 7A, is partially brought in contact with the stopper 114 to maintain the initial position. In this case, the end of the arm 120, as shown in FIG. 2, maintains to leave the predetermined distance from the tub 20. The ball 135, as shown in FIG. 6, lies between the transmitting unit 133 and the receiving unit 137. Hence, the receiving unit 137 fails to receive the signal of the transmitting unit 133, whereby no signal related to the vibration of the tub 20 is inputted to the control unit 50.

Under such a circumstance, if the tub 20 vibrates excessively, the tub 20 touches the arm 120 so that the arm 120, as shown in FIG. 7 B, rotates centering on the hinge shaft 121. The ball 135, as shown by a dotted circle in FIG. 6, then deviates from the initial position by inertia. Hence, the receiving unit 137 receives the signal of the transmitting unit 133 to output to the control unit 50.

Thus, once the signal of the transient vibration of the tub 20 is inputted to the control unit 50, the control unit 50 stops the motor 25. As the drum 30 slows down to stop, the vibration of the drum 20 is attenuated as well. Therefore, it is able to prevent the noise, the breakdown of the tub and cabinet 20 and 10, and shaking & movement of the washing machine, which are caused by the transient vibration of the tub.

Meanwhile, the arm 120 having rotated in the transient vibration of the tub 20 returns to the original position by the elastic force of the elastic member 140. In this case, the stopper 14 prevents the arm from excessively rotating, whereby the arm 120 maintains the initial position after having rotated to the initial position.

Accordingly, the washing machine according to the present invention has the following advantages or effects.

First of all, once the sensor assembly senses the transient vibration of the tub, the control unit stops the motor. Therefore, the present invention enables to prevent the noise, the breakdown of the tub and cabinet 20 and 10, and shaking & movement of the washing machine.

Secondly, in the sensor assembly, the bracket is temporarily fixed to the accurate position by the first hook and it then fixed to the cabinet strongly by the coupling member. Therefore, the present invention provides easy and convenient assembly work.

Thirdly, in the sensor assembly, the 'U'-type wall body is provided on the arm. Therefore, the sensor can be conveniently mounted on the arm with ease.

Fourthly, a plurality of the hooks and protrusions are provided to prevent the sensor mounted on the arm from being separated, whereby the sensor can be solidly mounted on the arm.

Fifthly, the arm is hinge-coupled to the bracket. As the bolt and washer are provided to the hinge-connection portion between the arm and the bracket, the arm enables to naturally rotate and the hinge4-connection portion is solid.

Sixthly, the elastic member is provided to the hinge-connection portion between the arm and the bracket, whereby the shock of the arm is reduced and the ram having rotated by the arm can return to the original position.

Seventhly, the stopper is provided to the bracket, whereby the initial and returning positions of the arm can be uniformly maintained.

Finally, in the sensor assembly, the ball moves when the arm rotates by the transient vibration of the tub. The receiving unit then receives the signal of the transmitting unit to output the signal to the control unit. Therefore, the sensor enables to sense the transient vibration of the tub immediately and accurately.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine, comprising:

a cabinet;

a tub provided in the cabinet;

a drum rotatably provided in the tub;

a motor provided in the cabinet and configured to rotate the drum;

a sensor assembly provided in the cabinet and configured to sense a transient vibration of the tub; and a controller that controls the motor and stops the motor when the tub experiences a transient vibration, wherein the sensor assembly comprises:

a bracket coupled to an interior of the cabinet;

an arm rotatably coupled to the bracket, wherein one end of the arm is positioned a predetermined distance from the tub such that the arm is contacted by the tub and rotates when the tub experiences a transient vibration; and a sensor mounted on the arm, wherein the sensor senses the transient vibration of the tub and outputs a corresponding signal to the controller when the arm rotates.

2. The washing machine as claimed in claim 1, the bracket comprising:

a first support member having a first lateral side positioned adjacent to a wall of the cabinet;

a second support member extending outward from a second lateral side of the first support member;

a first hole provided at the first support member and configured to receive a coupling member that penetrates the cabinet and that extends into the first hole; and a second hole provided in the second support member and that receives a corresponding portion of the arm so as to hinge-couple the arm to the bracket.

3. The washing machine as claimed in claim 2, the bracket further comprising a first hook that protrudes from the first lateral side of the first support members, wherein the first hook is configured to be inserted into a corresponding opening in the cabinet so as to temporarily fix the bracket to the cabinet.

4. The washing machine as claimed in claim 2, wherein the second lateral side of the first support member is opposite the first lateral side, wherein the second support member is positioned substantially perpendicular to the first support member, and wherein the second hole is provided at an end of the second support member that is opposite to the end which is coupled to the first support member.

5. The washing machine as claimed in claim 1, the arm comprising:

a hinge shaft extending from an end of the arm and that is coupled to the bracket; and a wall body provided on an upper surface of the arm, wherein the wall body receives the sensor.

6. The washing machine as claimed in claim 5, the arm further comprising a hook protruding from the wall body that engages an upper portion of the sensor received within the wall body.

7. The washing machine as claimed in claim 5, further comprising a protrusion protruding from an upper surface of the arm, wherein the protrusions engage a lower portion of the sensor received within the wall body so as to couple the sensor to the arm.

8. The washing machine as claimed in claim 5, the sensor assembly further comprising:

a bolt coupled to an end of the hinge shaft fitted to the bracket; and a washer positioned between a head of the bolt and the end of the hinge shaft.

9. The washing machine as claimed in claim 1, the sensor comprising:

a housing having a cavity therein, wherein the housing is configured to be mounted on the arm;

a transmitter installed at a first side of the housing;

a ball provided in the cavity and configured to move when the arm rotates; and a receiver installed at a second end of the housing so as to confront the transmitter, wherein the receiver is configured to receive a signal from the transmitter and to output a signal to the controller.

10. The washing machine as claimed in claim 9, the housing comprising:

a lower housing; and an upper housing configured to be coupled to the lower housing.

11. The washing machine as claimed in claim 9, wherein the ball is positioned between the transmitter and the receiver so as to block a signal generated by the transmitter from being received by the receiver when the arm is in an at rest position.

12. The washing machine as claimed in claim 9, wherein an inner bottom surface of the cavity is concave such that the ball remains stable when the arm is in an at rest position.

13. The washing machine as claimed in claim 12, wherein one of the transmitter or receiver is provided at an upper side of the housing, and the other one of the transmitter or receiver is provided at a lower side of the housing.

14. The washing machine as claimed in claim 9, wherein the cavity is substantially elliptical in cross section, and wherein an inner circumferential surface of the cavity is smooth so as to allow for substantially unimpeded movement of the ball within the cavity.

15. The washing machine as claimed in claim 1, the sensor further comprising a hook protruding from one side thereof, wherein the hook is inserted into a corresponding opening provided in the arm so as to couple the sensor the arm.

16. The washing machine as claimed in claim 1, the sensor assembly further comprising an elastic member configured to absorb a shock transferred to the arm in response to a transient vibration of the tub, wherein the elastic member is configured to return the arm from a rotated position to an at rest position.

17. The washing machine as claimed in claim 16, the elastic member comprising a spring having a first end engaged with the arms, and a second end engaged with the bracket.

18. The washing machine as claimed in claim 1, the bracket further comprising a stopper protruding from an upper surface thereof and configured to prevent a reverse rotation of the arm.

19. The washing machine as claimed in claim 18, the bracket further comprising a reinforcement rib protruding from the upper surface to a rear of the stopper and configured to reinforce the stopper when the stopper is pushed by the arm.

20. A transient vibration sensor assembly for a washing machine, comprising;

a bracket attached to an inside of a cabinet of a washing machine;

an arm hinge-coupled to the bracket, wherein one end of the arm is disposed a predetermined distance from a tub of the washing machine that the arm is contacted by the tub and rotates when the tub experiences transient vibration; and a sensor mounted on the arm, Wherein the sensor senses the transient vibration of the tub and outputs a sensing signal to a controller when the arm rotates, and wherein the sensor comprises a housing having a cavity inside, a transmitter installed at one side of the housing, a receiver installed at the other end of the housing to confront the transmitter and to receive a signal from the transmitter and to output a signal to a controller, and a ball provided in the cavity that moves when the arm rotates.

21. The transient vibration sensor assembly as claimed in claim 20, wherein the bracket comprises a first hole provided in a first lateral side thereof, wherein the first hole receives a coupling member that penetrates the cabinet, and a second hole provided at an end of the bracket, wherein the arm comprises a hinge shaft that extends into the second hole and a wall body provided on an upper surface that receives the sensor fitted thereto.

* * * * *